US005738459A

United States Patent [19]

Smith

[11] Patent Number: 5,738,459

[45] **Date of Patent: *Apr. 14, 1998**

[54] "PRESSURIZED REFILL WITH MULTIPLE SEAL VALVE CORE PLUG AND A METHOD FOR PRESSURIZING A REFILL"

[75] Inventor: Paul A. Smith, Glenview, Ill.

[73] Assignee: Eversharp Pen Company, Franklin Park, Ill.

[ * ] Notice: The term of this patent shall not extend beyond the expiration date of Pat. No. 5,628,576.

[21] Appl. No.: 641,738

[22] Filed: May 2, 1996

Related U.S. Application Data

[63] Continuation-in-part of Ser. No. 437,017, May 8, 1995, Pat. No. 5,628,576.

[51] Int. Cl.[6] ..... B43K 7/03

[52] U.S. Cl. ..... 401/190; 401/188 R; 401/188 A

[58] Field of Search ..... 401/141, 142, 401/187, 188 R, 188 A, 190

[56] References Cited

U.S. PATENT DOCUMENTS

| | | | |
|---|---|---|---|
| 224,162 | 2/1880 | Fisher et al. | 401/487 |
| 827,758 | 8/1906 | Smith et al. | 401/187 |
| 2,382,314 | 8/1945 | Herb | 401/188 X |
| 3,115,868 | 12/1963 | DeMolin et al. . | |
| 3,420,610 | 1/1969 | Malm . | |
| 3,425,779 | 2/1969 | Fisher et al. . | |
| 3,775,015 | 11/1973 | Tsunoda et al. . | |
| 3,997,273 | 12/1976 | Germann | 401/190 |
| 4,498,797 | 2/1985 | Peper et al. . | |
| 4,587,999 | 5/1986 | Boiko et al. . | |

FOREIGN PATENT DOCUMENTS

| | | | |
|---|---|---|---|
| 316210 | 5/1989 | European Pat. Off. | 401/188 R |

*Primary Examiner*—Steven A. Bratlie
*Attorney, Agent, or Firm*—Hill, Steadman & Simpson

[57] ABSTRACT

A pressurized refill and a method for pressurizing a refill are provided. The refill has a plug secured at an end of the refill having multiple seals between the plug and an interior wall of the refill. A valve extends through a channel of the plug allowing pressurized gas to be forced into an interior of the refill to pressurize or re-pressurize the interior of the refill. A spring loaded stem maintains the valve in a closed and sealed position when pressurization is not being effected.

16 Claims, 2 Drawing Sheets

"PRESSURIZED REFILL WITH MULTIPLE SEAL VALVE CORE PLUG AND A METHOD FOR PRESSURIZING A REFILL"

This application is a continuation-in-part of commonly assigned, U.S. patent application Ser. No. 08/437,017, filed on May 8, 1995 now U.S. Pat. No. 5,628,576.

BACKGROUND OF THE INVENTION

The present invention generally relates to a pressurized refill for a pen. More specifically, the present invention relates to a sealed plug having a valve for use in selectively pressurizing a pen refill as well as sealing the refill.

It is, of course, generally known to provide a writing instrument with ink therein, commonly referred to as a pen. Often, pens are provided with a cartridge or a refill such that when the ink within the pen or refill is fully depleted, only the refill requires replacement. As a result, a number of decorative pen housings can be provided to receive a standard refill so that the housing can be repeatedly used, and replacement of the refill only is required.

It is also generally known to provide a refill with ink therein that is constantly acted upon by gas pressure. Such refills, when in use within pens, allow for a smooth and continuous flow of ink regardless of the orientation of the pen itself. However, such pressurized pen refills are typically only sealed at an end of the refill. Therefore, the gas pressurizing the refill slowly leaks from the refill rendering the ink refill inoperative or, at least, less effective.

Further, recharging of the refill with gas is often impossible or difficult to achieve. Therefore, after the gas is discharged from the refill or substantially reduced, the refill may become inoperative. This results in a substantially shorter shelf-life for the refill.

A need, therefore, exists for an improved refill having a valved core plug and at least one seal peripherally extending around the plug. Further, an improved method for recharging a refill with a gas is also required.

SUMMARY OF THE INVENTION

The present invention provides a pen refill and a method for pressurizing a pen refill. The refill has an end sealed with a plug. The plug is spring biased to selectively pressurize a barrel in which ink for the pen refill is contained. The plug is designed for simple pressurization of the barrel, if necessary, and maintenance of a sealed interior of the barrel and, hence, constant pressure therein.

To this end, the present invention provides a refill pressurized with a gas having a barrel with a wall defining an interior defined by the wall extending between a first end and a second end, the first end terminating in a writing tip wherein the interior contains ink therein. Further, a plug is provided having an interior defined between a first end and a second end wherein the second end of the plug is insertable into the second end of the barrel wherein the barrel has a plurality of seals around the periphery of the plug to seal the plug against the wall in the interior of the barrel. Valve means is constructed and arranged to selectively permit the gas to enter the interior of the barrel through the interior of the plug wherein the valve means has a stem extending through the interior of the plug and further wherein the stem includes a spring associated with the valve means and biased to maintain the valve means in a closed position wherein the spring is arranged between the first end of the plug and a point intermediate the first end and the second end of the plug.

In an embodiment, the plurality of seals is three.

In an embodiment, one of the plurality of seals is associated with the valve means and moves with the valve means when the spring is compressed.

In an embodiment, one of the plurality of seals is distinctly shaped from a remainder of the plurality of seals.

In an embodiment, one of the plurality of seals has a diameter greater than a diameter of the plug.

In an embodiment, one of the plurality of seals has a diameter substantially equal to a diameter of the plug.

In another embodiment of the present invention, a method is provided for pressurizing a refill with a gas. The method comprises the steps of: providing a barrel having walls defining an interior capable of holding ink therein wherein the interior is defined by the walls extending between a first end and a second end and further wherein the first end terminates in a writing tip; inserting a plug having an interior defined between a first end and a second end wherein the second end of the plug is inserted through the second end of the barrel wherein the plug has a plurality of peripheral seals capable of sealing the plug against the walls in the interior of the barrel; providing a valve constructed and arranged to seal the second end of the plug wherein the valve means has a stem extending through the interior of the plug; providing a spring associated with the valve extending along the stem to bias the valve in a closed position wherein the spring is arranged between the first end of the plug and a point intermediate the first end and the second end of the plug; and selectively pressurizing the ink in the barrel of the refill by forcing the gas through the plug past the valve at the second end of the plug.

In an embodiment, one of the plurality of seals seals an opening through the plug.

In an embodiment, one of the plurality of seals is distinctly shaped from a remainder of the plurality of seals.

In another embodiment of the present invention, a pen refill pressurized with a gas is provided. The refill has a shell having walls defining an interior defined by the walls extending between a first end and a second end of the shell. Ink is provided within the interior of the shell, and a writing tip terminates the first end of the shell. Plug means has an interior defined between a first end and a second end wherein the second end of the plug means is insertable through the second end of the shell wherein the plug means includes a stem extending through the interior of the plug means. Seal means is constructed and arranged around a periphery of the plug means to seal the plug means against the walls in the interior of the shell. Valve means is associated with the plug means and is capable of selectively allowing the gas to enter the interior of the shell. A spring is associated with the stem through the plug means to bias the valve means in a closed position wherein the spring is arranged between the first end of the plug means and a point intermediate the first end and the second end of the plug means.

In an embodiment, the plurality of seals is three.

In an embodiment, one of the plurality of seals is distinctly shaped from a remainder of the plurality of seals.

In an embodiment, one of the plurality of seals has a diameter substantially greater than a diameter of the plug means.

In an embodiment, one of the plurality of seals has a diameter substantially equal to a diameter of the plug.

In an embodiment, one of the plurality of seals is cooperatively attached to the valve means and moves with the valve means when the spring is compressed.

It is, therefore, an advantage of the present invention to provide a system and a method for pressurizing a pen refill.

Another advantage of the present invention is to provide a system and a method for maintaining the pressure in a pressurized refill.

A further advantage of the present invention is to provide a system and a method for refilling a pressurized refill with gas.

Yet another advantage of the present invention is to provide a system and a method for improving the shelf-life of a pen refill.

And, another advantage of the present invention is to provide a system and a method for prolonging freshness of ink contained within a refill.

A still further advantage of the present invention is to provide a system and a method for recharging of gas within a refill at any time.

Moreover, an advantage of the present invention is to provide a refill and a method for refilling that has improved overall writing performance and smoothly flowing ink without clogging, blobbing and/or messiness.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention provides a pen refill and a method for refilling a pen with a gas to pressurize the ink within the refill. In a preferred embodiment, the refill includes a double sealed plug with a valve extending therethrough for pressurizing the refill with a gas.

Figure 1:
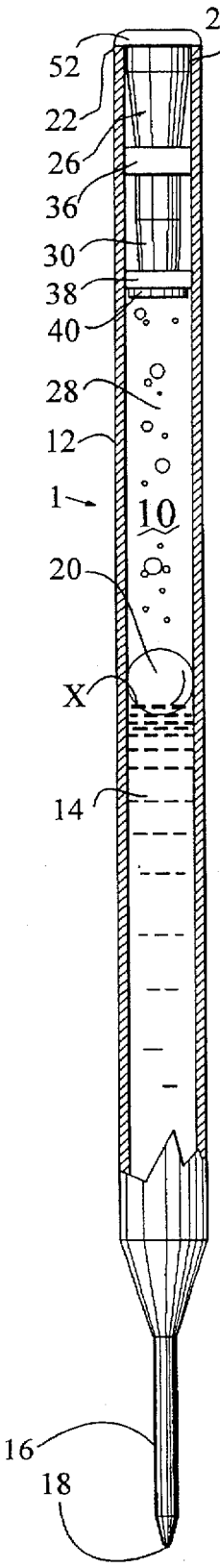
FIG. 1 illustrates a cross-sectional view of an embodiment of a pen refill of the present invention.

Referring now to the drawings wherein like numerals refer to like parts, FIG. 1 illustrates a refill 1 having an interior 10 defined by a body 12 partially filled with ink 14. The body 12 is substantially and uniformly cylindrical along its length and tapers toward its distal end 16 and forms a writing tip 18, such as a ball point. The ink 14 supports a follower 20 at a level X as shown in FIG. 1. Therefore, the ink 14 is contained within the body 12 of the refill 1 between the follower 20 at the level X and the writing tip 18 at the distal end 16. At an opposite end 22 from the distal end 16 is an opening 24 through which a plug 26 can be inserted. Between the plug 26 and the follower 20 is a pressurized gas generally designated at 28. The gas 28 is pressurized to maintain a constant and continuous pressure on the follower 20 such that the ink 14 evenly and continuously flows through the writing tip 18 when the refill 1 is used, for example, within a pen housing (not shown).

Figure 2:
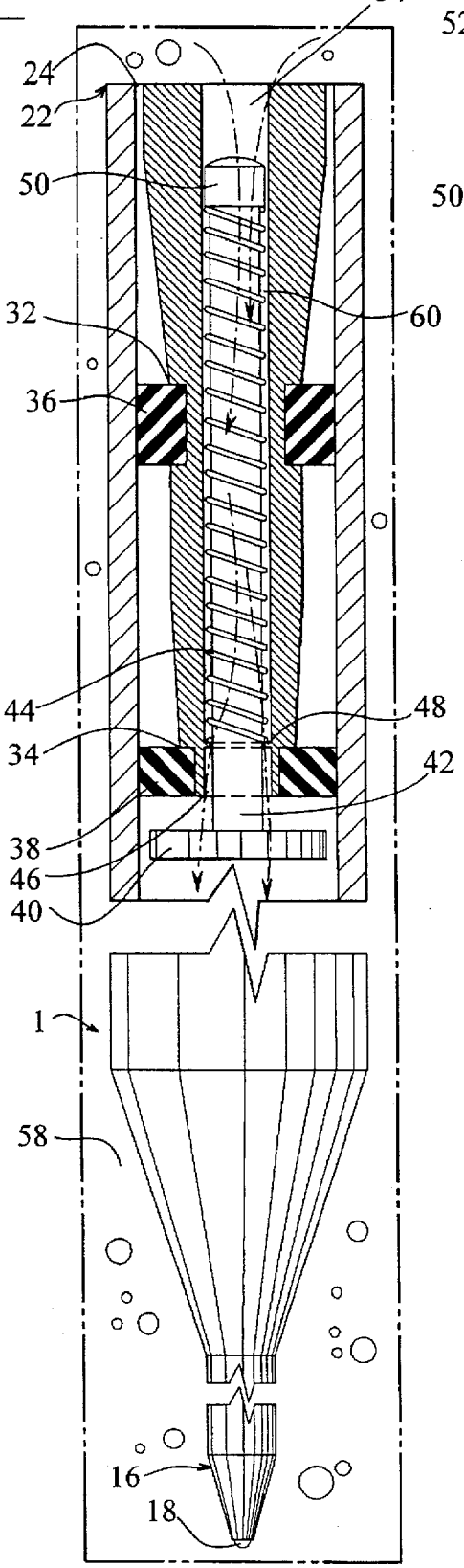
FIG. 2 illustrates an enlarged cross-sectional view, partially cut away, of an embodiment of the pen refill system in a gas recharging mode.
Figure 3:
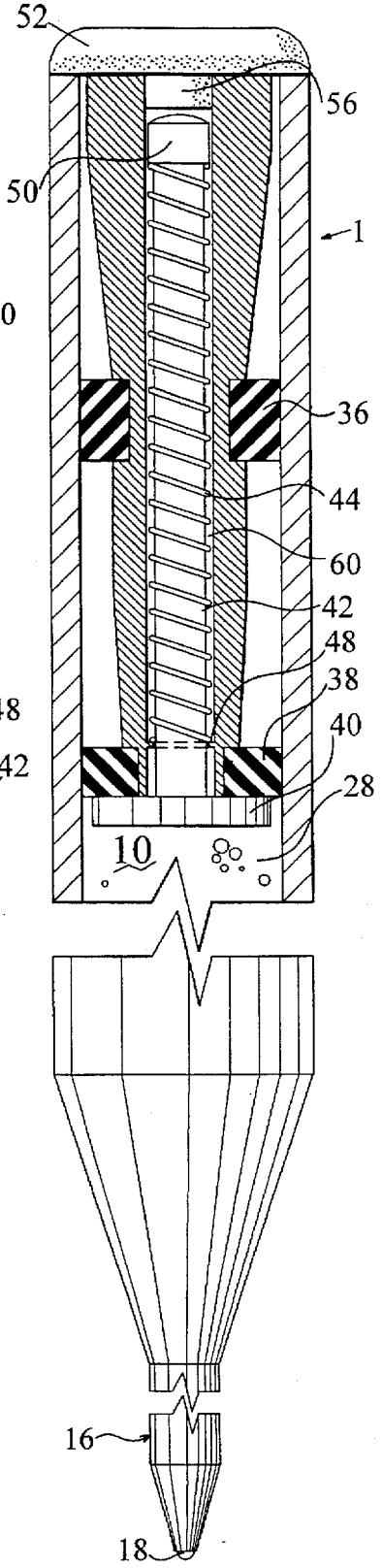
FIG. 3 illustrates an enlarged cross-sectional view, partially cut away, of an embodiment of the pen refill system following gas recharging.

As illustrated in FIG. 1, and more clearly shown in FIGS. 2 and 3, the plug 26 includes a body 30. Around the body is a first recess 32 and a second recess 34. Secured around each of the recesses 32,34 is a seal 36,38, respectively. Preferably, two seals are implemented but a single seal or more than two seals may be implemented by those skilled in the art. The first seal 36 is located intermediate the ends of the plug 26. The second seal 38 is preferably located at an end of the plug 26. With the seal 28 at the end of the plug 26, a valve 40, in its closed position as shown in FIGS. 1 and 3, rests against the seal 38 and positively seals the interior 10 of the refill 1.

As illustrated in FIGS. 2 and 3, the valve 40 has a stem 42 attached thereto. Around the stem 42 is a spring 44. The spring 44 is biased to maintain the valve 40 and the stem 42 in the position illustrated in FIG. 3 such that the valve 40 closes and seals an opening 46 formed in an end of the plug 26. Within the plug 26 is a seat 48 on which the spring 44 rests preventing further advancement of the spring 44. On an opposite end of the stem 42 is a cap 50 providing a seat for an opposite end of the spring 44. A second cap 52 may be further provided to enclose the opening 24 as well as the opening 54 at the end of the plug 26 and the end 22 of the body 12 of the refill 1 is shown. The cap 52 is removable and includes a plug 56 insertable into the opening 54 at the end of the plug 26.

Referring now to FIG. 2, charging of the refill 1 with a gas 58 such that the gas 58 enters into the interior 10 of the refill 1 is illustrated. In an embodiment, the refill 1 or a plurality of refills may be placed within a pressurized chamber and the gas 58 may be forced through a channel 60 formed through the plug 26 in the direction of the arrows in FIG. 2. The pressurized gas 58 forces the valve 40 and hence the spring 44 and stem 42 to the position illustrated in FIG. 2. Entry of the pressurized gas 58 into the interior 10 of the refill 1 is thereby achieved.

Following release of the pressurized gas 58 forcing entry of the gas into the interior 10 of the refill 1, the cap 52 may be secured to the end 24 of the refill 1 enclosing the opening 24 of the refill 1 and the opening 54 of the plug 26. As shown in FIG. 3, the seals 36 and 38 prevent release of the gas 28 within the interior 10 of the refill 1. As a result, an effective method is provided for initially charging or recharging of a refill as well as effectively maintaining the pressurized gas 28 within the interior 10 of the refill 1.

It should be understood that each of the refills 1 may be individually charged by application of a pressurized gas source to the end 22 of the refill forcing pressurized gas through the channel 60 and into the interior 10 of the refill 1. Of course, other known gas pressurizing methods may be implemented using the plug 26, valve 40 and arrangement of seals 36, 38 of the present invention.

Figure 4:
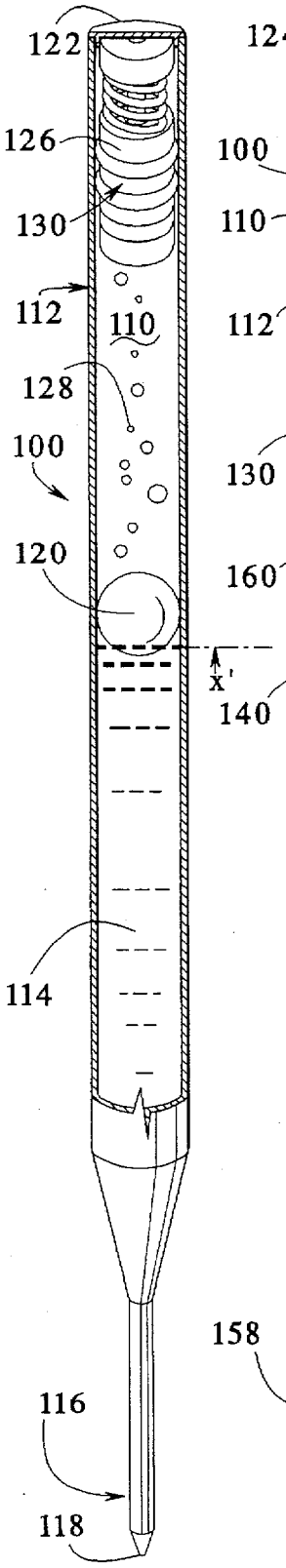
FIG. 4 illustrates a cross-sectional view of another embodiment of a pen refill of the present invention.
Figure 5:
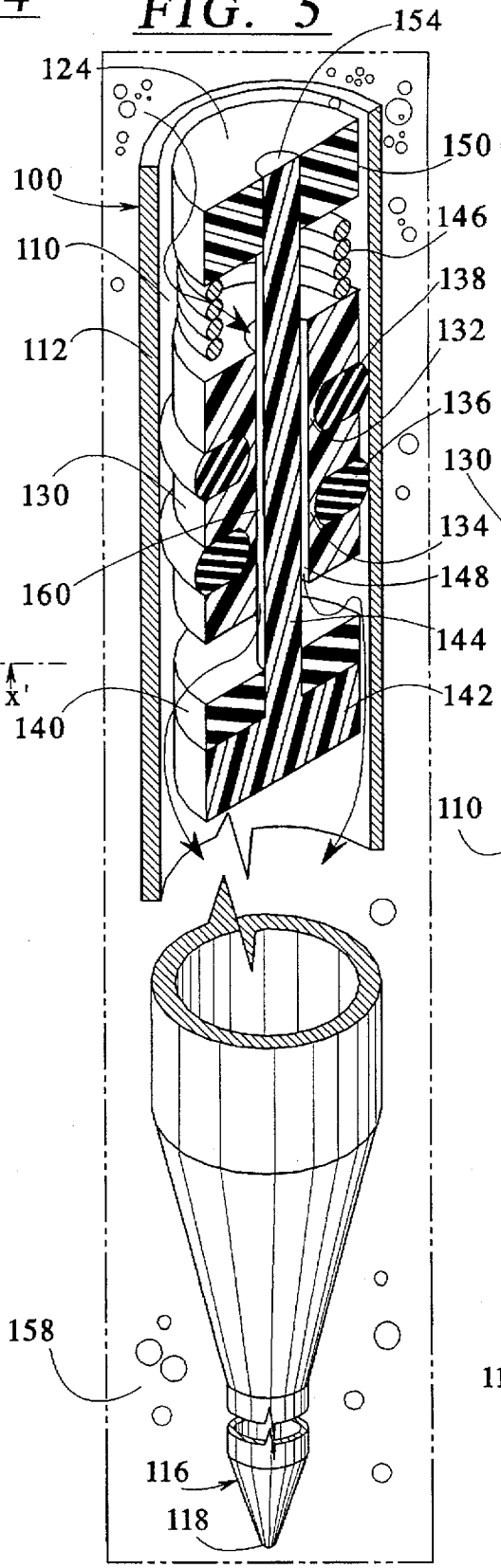
FIG. 5 illustrates an enlarged cross-sectional view, partially cut away, of another embodiment of the pen refill system in a gas recharging mode.
Figure 6:
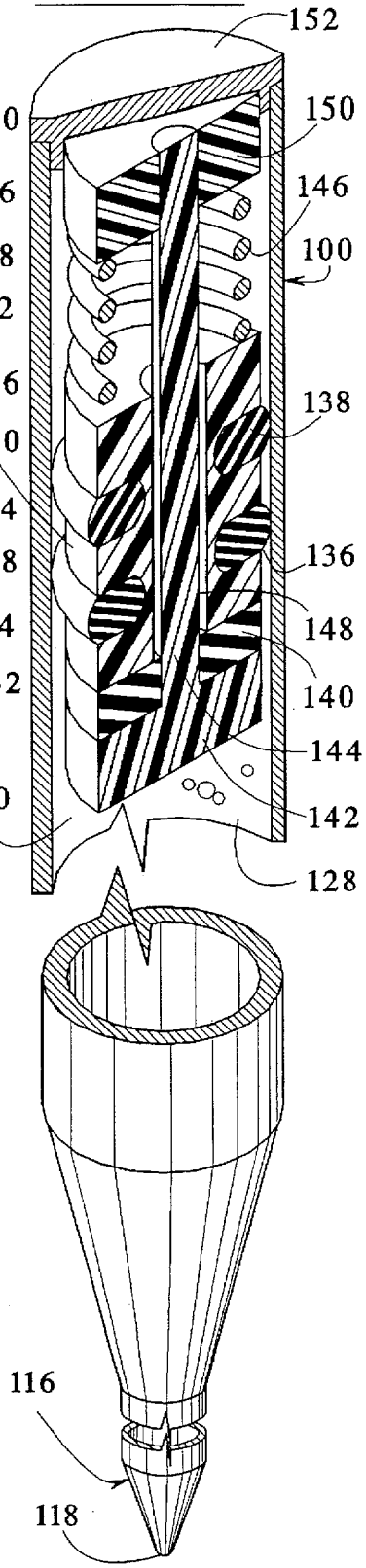
FIG. 6 illustrates an enlarged cross-sectional view, partially cut away, of another embodiment of the pen refill system following gas recharging.

Referring now to FIGS. 4–6, another embodiment of a refill 100 is illustrated. The refill 100 has an interior 110 defined by a body 112 partially filled with ink 114. The body 112 is substantially and uniformly cylindrical along its length and tapers towards its distal end 116 and forms a writing tip 118, such as a ball point. The ink 114 supports a follower 120 at a level X' as shown in FIG. 4. Therefore, the ink 114 is contained within the body 112 of the refill 100 between the follower 120 at the level X' and the writing tip 118 at the distal end 116.

At an opposite end 122 from the distal end 116 is an opening 124 (see FIG. 5) through which a plug 126 can be inserted. Between the plug 126 and the follower 120 is a pressurized gas generally designated at 128. The gas 128 is pressurized to maintain a constant and continuous pressure on the follower 120 such that the ink 114 evenly and continuously flows through the writing tip when the refill 100 is used, for example, within a pen housing (not shown).

As illustrated in FIG. 4 and more clearly shown in FIGS. 5 and 6, the plug 126 includes a body 130. Around the body 130 in a spaced area 132 and a second spaced area 134. Secured in each of the spaced areas 132 and 134 are seals 136, 138. Preferably, two seals are implemented, but a single seal more than two seals may be implemented by those skilled in the art. The seals 136,138 have a diameter slightly greater than the body 130 to form a seal between interior walls of the body 112 in the interior 110 of the refill 100.

Therefore, as illustrated, the body 130 of the plug 126 is constructed in a central portion of three substantially identical sections, each of which is separated by one of the spaced areas 132,134. As a result, the seals 136,138 may be placed in the spaced areas 132,134.

A third seal 140 is cooperatively associated with a valve 142 that is integrally formed with a stem 144. Around the stem 144 at an end opposite the valve 142 is a spring 146. The spring 146 is biased to maintain the valve 142 with the seal 140 in the position illustrated in FIG. 6 such that the seal 140 closes and seals an opening 148 formed through the plug 126 around the stem 144.

As illustrated in FIGS. 5 and 6, one section of the body 130 forms a seat on which the spring 146 rests preventing further advancement of the spring 146. An end section 150 seats the spring 146 at its opposite end. An additional cap 152 may be further provided to enclose the opening 124 and maintain the plug 126 in the illustrated position.

Referring now to FIG. 5, charging of the refill 100 with a gas 158 is shown such that the gas 158 enters into the interior 110 of the refill 100. In an embodiment, the refill 100 or a plurality of refills may be placed within a pressurized chamber, and the gas 158 may be forced through a channel 160 formed adjacent the stem 144 in the direction of the arrows in FIG. 5. The pressurized gas 158 forces the valve 142 with the associated seal 140 and, hence, the spring 146 and the stem 144 to the position illustrated in FIG. 5. Entry of the pressurized gas into the interior 110 of the refill 100 is thereby achieved.

Following release of the pressurized gas 158 forcing entry of the gas 158 into the interior 110 of the refill 100, the cap 152 may be secured to the end 124 of the refill 100 enclosing the opening 124 of the refill 100 and an opening 154 at an end of the plug 126. As shown in FIG. 6, the seals 136,138 prevent release of the gas 158 within the interior 110 of the refill 100. The seal 140 seals the opening 148 at the end of the channel 160 following pressurization of the refill 100 with the gas 158. As a result, an effective method is provided for initially charging or recharging of a refill 100 as well as effectively maintaining the pressurized gas 158 within the interior 110 of the refill 100.

As before, with respect to the embodiment illustrated in FIGS. 1–3, each of the refills 100 may be individually charged by application of a pressurized gas source to the end 122 of the refill 100 forcing pressurized gas 158 through the channel 160 and into the interior 110 of the refill 100. Of course, other known gas pressurizing methods may be implemented using the plug 126 with its specific arrangement of its valve and seals.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A refill pressurized with a gas, the refill comprising:

a barrel having a wall defining an interior defined by the wall extending between a first end and a second end, the first end terminating in a writing tip wherein the interior contains ink therein;

a plug having an interior defined between a first end and a second end wherein the second end of the plug is insertable into the second end of the barrel wherein the barrel has a plurality of seals around the periphery of the plug to seal the plug against the wall in the interior of the barrel;

a cap removably secured to the second end of the barrel wherein removal of the cap does not affect the ink sealed in the barrel by the plug; and valve means constructed and arranged to selectively permit the gas to enter the interior of the barrel through the interior of the plug wherein the valve means has a stem extending through the interior of the plug and further wherein the stem includes a spring associated with the valve means and biased to maintain the valve means in a closed position wherein the spring is arranged between the first end of the plug and a point intermediate the first end and the second end of the plug.

2. The refill of claim 1 wherein the plurality of seals is three.

3. The refill of claim 1 wherein one of the plurality of seals is associated with the valve means and moves with the valve means when the spring is compressed.

4. The refill of claim 1 wherein one of the plurality of seals is distinctly shaped from a remainder of the plurality of seals.

5. The refill of claim 1 wherein one of the plurality of seals has a diameter greater than a diameter of the plug.

6. The refill of claim 1 wherein one of the plurality of seals has a diameter substantially equal to a diameter of the plug.

7. A method for pressurizing a refill with a gas, the method comprising the steps of:

providing a barrel having walls defining an interior capable of holding ink therein wherein the interior is defined by the walls extending between a first end and a second end and further wherein the first end terminates in a writing tip;

inserting a plug having an interior defined between a first end and a second end wherein the second end of the plug is inserted through the second end of the barrel wherein the plug has a plurality of peripheral seals capable of sealing the plug against the walls in the interior of the barrel;

providing a valve constructed and arranged to seal the second end of the plug wherein the valve has a stem extending through the interior of the plug;

providing a cap removably secured to the second end of the barrel wherein removal of the cap does not affect the gas pressurized in the refill;

providing a spring associated with the valve extending along the stem to bias the valve in a closed position wherein the spring is arranged between the first end of the plug and a point intermediate the first end and the second end of the plug; and selectively pressurizing the ink in the barrel of the refill by forcing the gas through the plug past the valve at the second end of the plug.

8. The method of claim 7 wherein one of the plurality of seals seals an opening through the plug.

9. The method of claim 7 wherein one of the plurality of seals is distinctly shaped from a remainder of the plurality of seals.

10. The method of claim 7 wherein the plurality of seals is three.

11. A pen refill pressurized with a gas, the refill comprising:

a shell having walls defining an interior defined by the walls extending between a first end and a second end of the shell;

ink within the interior of the shell;

a writing tip terminating the first end of the shell;

plug means having an interior defined between a first end and a second end wherein the second end of the plug is insertable through the second end of the shell wherein the plug means includes a stem extending through the interior of the plug means;

a plurality of seals constructed and arranged around a periphery of the plug means to seal the plug means against the walls in the interior of the shell;

valve means associated with the plug means capable of selectively allowing the gas to enter the interior of the shell;

cap means removably secured to the second end of the shell wherein removal of the cap means does not affect the ink sealed in the shell; and a spring associated with the stem through the plug means to bias the valve means in a closed position wherein the spring is arranged between the first end of the plug means and a point intermediate the first end and the second end of the plug means.

12. The refill of claim 11 wherein the plurality of seals is three.

13. The refill of claim 11 wherein one of the plurality of seals is distinctly shaped from a remainder of the plurality of seals.

14. The refill of claim 11 wherein one of the plurality of seals has a diameter substantially greater than a diameter of the plug means.

15. The refill of claim 11 wherein one of the plurality of seals has a diameter substantially equal to a diameter of the plug.

16. The refill of claim 11 wherein one of the plurality of seals is cooperatively attached to the valve means and moves with the valve means when the spring is compressed.

* * * * *

UNITED STATES PATENT AND TRADEMARK OFFICE

CERTIFICATE OF CORRECTION

PATENT NO. : 5,738,459
DATED : April 14, 1998
INVENTOR(S) : Paul A. Smith

It is certified that error appears in the above-indentified patent and that said Letters Patent is hereby corrected as shown below:

At Column 5, line 12, after "seal", insert --or--.

Signed and Sealed this

Twenty-fourth Day of November,1998

*Attest:*

BRUCE LEHMAN

*Attesting Officer*

*Commissioner of Patents and Trademarks*